United States Patent [19]

White

[11] 4,210,035

[45] Jul. 1, 1980

[54] BOOT BUCKLING AID

[76] Inventor: Carl A. White, 41 Woodland Dr., Fargo, N. Dak. 58102

[21] Appl. No.: 959,291

[22] Filed: Nov. 9, 1978

[51] Int. Cl.[2] ..... B25B 27/00

[52] U.S. Cl. ..... 81/3 R; 24/70 SK

[58] Field of Search ..... 24/69 SK, 70 SK, 71.3; 74/544; 81/3 R, 3.46 R, 3.46 A

[56] References Cited

U.S. PATENT DOCUMENTS

| | | | |
|---|---|---|---|
| 3,713,200 | 1/1973 | Burns | 81/3.46 R X |
| 3,864,769 | 2/1975 | Hamilton | 81/3 R X |
| 3,902,226 | 9/1975 | Messenbaugh | 81/3.46 R X |
| 4,034,595 | 7/1977 | Smith | 81/3 R X |
| 4,133,228 | 1/1979 | DePooter | 81/3.46 A X |

*Primary Examiner*—James G. Smith

*Attorney, Agent, or Firm*—Schroeder, Siegfried, Ryan, Vidas, Steffey & Arrett

[57] ABSTRACT

A device for aiding the operation of boot buckles having a pivotally attached tensioning lever and a clamping loop, comprising an elongated member having a handle end and a second end having a socket therein adapted to receive the tensioning lever to facilitate the movement thereof when in engagement with the clamping loop.

5 Claims, 4 Drawing Figures

BOOT BUCKLING AID

BACKGROUND OF THE INVENTION

The present invention relates to boots having buckle closures thereon, and more particularly to a device for assisting in the opening and closing of such buckle closures.

Many modern boots, and particularly ski boots, are typically provided with buckle devices for tightening the boot around the foot of the person wearing same. Such buckle devices conventionally comprise a tensioning lever which is pivotally attached to one instep portion of the boot and a clamping loop, which is engageable with the lever, attached to the other instep portion of the boot.

During use, the buckle devices are first placed in an open position to allow the insertion of the foot of the wearer into the boot, following which the tensioning lever of each buckle is engaged with the clamping loop and closed to securely retain the wearer's foot in the boot.

In many instances, the closing or opening of the buckle device can require a great amount of effort, and can be cumbersome, for a variety of reasons, e.g., the quality or condition of the equipment, the age or condition of the wearer, and in the case of ski boots, the amount of clothing and other items the skier has on at the time.

It has now been found that a simple device can be utilized to assist the boot wearer in the buckling or unbuckling operation.

SUMMARY OF THE INVENTION

In accordance with the invention there is provided a device for aiding the opening and closing of boot buckles having a pivotally attached tensioning lever and a clamping loop engageable therewith, comprising an elongated member having a handle end and a second end having a socket therein, the socket being adapted to receive at least a portion of the tensioning lever to facilitate the movement thereof when engaged with the clamping loop.

Preferably, the socket end is bifurcated to provide the lever-receiving socket area, and the bifurcated end is arcuately shaped, especially if the buckle tensioning lever is arcuate in shape.

By use of my device, the opening and closing of such boot buckles can be greatly simplified.

DETAILED DESCRIPTION OF THE INVENTION

Figure 2:
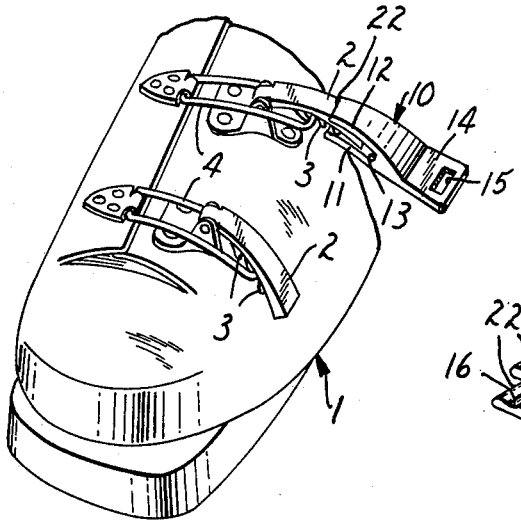
FIG. 2 is a perspective view of the device of FIG. 1 in operating relationship with a buckle device contained on a boot, typically a ski boot.
Figure 1:
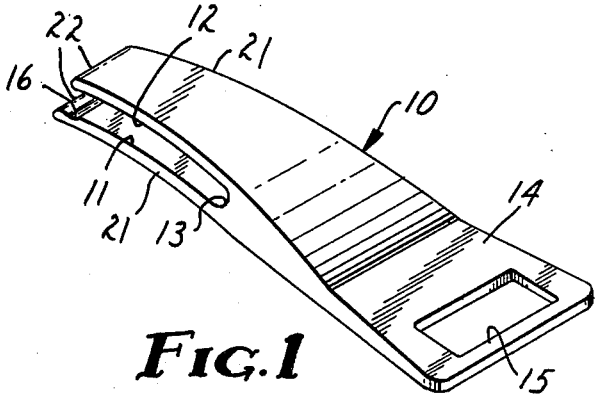
FIG. 1 is a perspective view of a device embodying my invention.

In the drawings, a preferred device of my invention is illustrated, which is an elongated member 10 comprising handle end 14 and bifurcated end 21, with lower and upper members 11 and 12 of bifurcated end 21, defining a slot 13 therebetween for receiving the tensioning lever of a boot buckle. Preferably, at least one of members 11 or 12 has a transverse groove 16 so as to insure non-slippage of the device from the boot buckle tensioning lever, especially if the tensioning lever is toothed.

Also, preferably, slot 15 in handle end 14 is present to allow simple engagement of the tensioning lever when same is in a closed position and thereby facilitate opening of the boot buckle, although bifurcated end 21 can also be used as the buckle opening means.

FIG. 2 illustrates the device of my invention in operating relationship with a boot buckle. As is illustrated, the boot buckle is comprised of tensioning lever 2, shown with teeth 3, pivotally attached to one instep portion of boot 1. Attached to the other instep portion of boot 1 is clamping loop 4. After clamping loop 4 is engaged with tensioning lever 2, elongated member 10, my invention, is simply held by handle end 14 and applied onto lever 2 whereupon the buckle can be closed. Transverse groove 16 of lower memer 11 is shown to contact one of teeth 3, if they are present, to insure that member 10 does not slip during operation.

To open the buckle, the process can be simply reversed or, if present, slot 15 in handle end 14 can be applied to lever 2 and the tensioning lever "popped" open.

Figure 3:
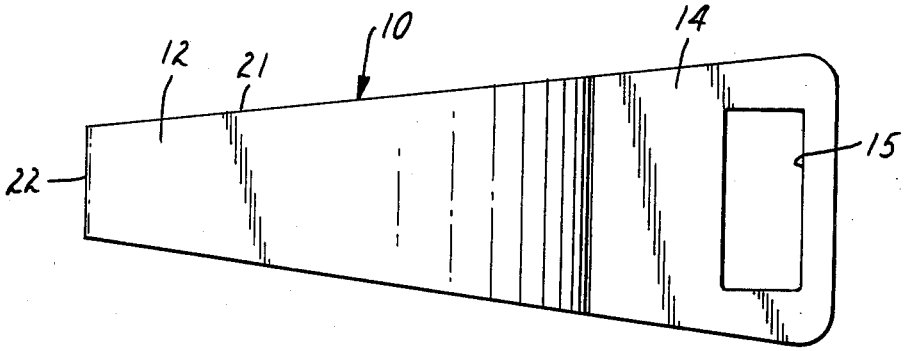
FIG. 3 is a top view of the device illustrated in FIG. 1.
Figure 4:
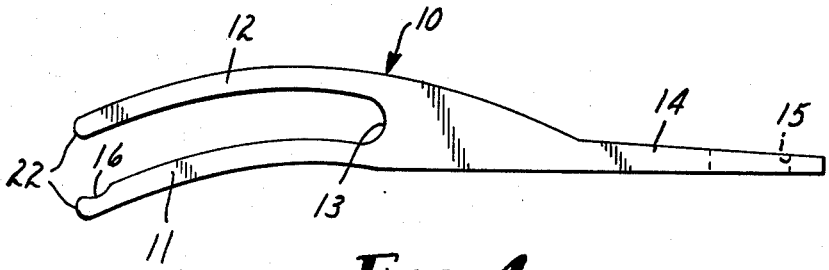
FIG. 4 is a side view thereof.

FIGS. 3 and 4 further illustrate the preferred construction of my invention. In FIG. 3, bifurcated end 21 is illustrated to be tapered such that terminal portion 22 thereof is of a width less than the clamping loop 4 of FIG. 2 to allow greater penetration of lever 2 into slot 13. FIG. 4 illustrates members 11 and 12 of bifurcated end 21 being arcuately shaped, because in many instances tensioning lever 2 is arcuate in shape to adapt more closely to the shape of the boot when in a closed position.

My device can be constructed of any conventional material which will afford sufficient rigidity to allow functionality thereof. Metallic materials, such as aluminum, are preferred because of wear capabilities, but if economics is a factor, the device can be constructed of conventional plastic materials.

I claim:

1. A device for aiding the opening and closing of boot buckles, wherein said boot buckles comprise a tensioning lever having a curve therein to conform to the surface of said boot when said buckle is closed, said tensioning lever pivotally attached to one instep portion of said boot and a clamping loop engageable with said lever attached to the other instep portion of said boot, said device comprising an elongated member having a handle end for grasping said member and a bifurcated gripping end having rigid, spaced upper and lower segments, said upper and lower segments being curved to engage a substantial portion of said tensioning lever to facilitate operation of said clamping loop.

2. The device of claim 1 wherein said segments of said bifurcated gripping end are tapered such that the width thereof of the terminal portions is less than the width of said clamping loop.

3. The device of claim 1 wherein at least one of said segments of said bifurcated gripping end has a transverse groove at the terminal portion thereof for engaging said tensioning lever.

4. The device of claim 1 wherein said handle end has a slot therein adapted to engage the terminal portion of said tensioning lever when said boot buckle is in a closed position.

5. The invention of claim 3 wherein the lower segment of said bifurcated gripping end has said transverse groove.

* * * * *